US006539688B2

(12) United States Patent
Fahs et al.

(10) Patent No.: US 6,539,688 B2
(45) Date of Patent: Apr. 1, 2003

(54) EASY OPEN PACKAGE FOR FOOD ITEMS SUCH AS LOAVES OF PROCESSED CHEESE

(75) Inventors: Kenneth Fahs, Green Bay, WI (US); David Sullivan, Green Bay, WI (US); Michael Nooyen, Green Bay, WI (US)

(73) Assignee: Schreiber Foods, Inc., Green Bay, WI (US)

( * ) Notice: Subject to any disclaimer, the term of this patent is extended or adjusted under 35 U.S.C. 154(b) by 0 days.

(21) Appl. No.: 10/036,030

(22) Filed: Oct. 29, 2001

(65) Prior Publication Data

US 2002/0083681 A1 Jul. 4, 2002

Related U.S. Application Data

(63) Continuation of application No. 09/493,910, filed on Jan. 28, 2000, now Pat. No. 6,339,912.

(51) Int. Cl.[7] ..... B65B 61/18

(52) U.S. Cl. ..... 53/412; 53/133.5; 53/133.6; 53/133.7; 53/133.8

(58) Field of Search ..... 53/133.5, 133.7, 53/412, 461, 466, 133.6, 133.8, 463

(56) References Cited

U.S. PATENT DOCUMENTS

| | | | | | |
|---|---|---|---|---|---|
| 1,661,479 | A | * | 3/1928 | Josephson | 229/87.08 |
| 1,965,524 | A | * | 7/1934 | Melhorn | 493/84 |
| 2,322,594 | A | | 6/1943 | Russell | 229/51 |
| 2,790,594 | A | | 4/1957 | Hutkrans et al. | 229/87 |
| 3,000,744 | A | * | 9/1961 | Lingebach, Jr. | 229/87.05 |
| 3,013,368 | A | * | 12/1961 | Macomber | 225/103 |
| 3,092,251 | A | | 6/1963 | Jaggers | 206/63.2 |
| 3,132,028 | A | * | 5/1964 | Austin et al. | 229/87.09 |
| 3,392,503 | A | * | 7/1968 | Vaughan | 53/461 |
| 3,419,206 | A | * | 12/1968 | Omori | 206/497 |
| 6,339,912 | B1 | * | 1/2002 | Fahs et al. | 53/133.7 |

FOREIGN PATENT DOCUMENTS

| | | |
|---|---|---|
| FR | 1.186.776 | 11/1957 |

OTHER PUBLICATIONS

EPO Search Report Dec. 18, 2001.

* cited by examiner

*Primary Examiner*—Scott A. Smith
*Assistant Examiner*—Nathaniel Chukwurah
(74) *Attorney, Agent, or Firm*—Niro, Scavone, Haller & Niro

(57) ABSTRACT

A hermetically sealed package for food items, such as loaves of processed cheese, employing plastic film with serrated ends and an accessible tear strip, which together provide points of focus for easy opening of the package without unwanted tearing or undesirable contamination of the food item. A process for forming this package also forms part of the invention.

6 Claims, 5 Drawing Sheets

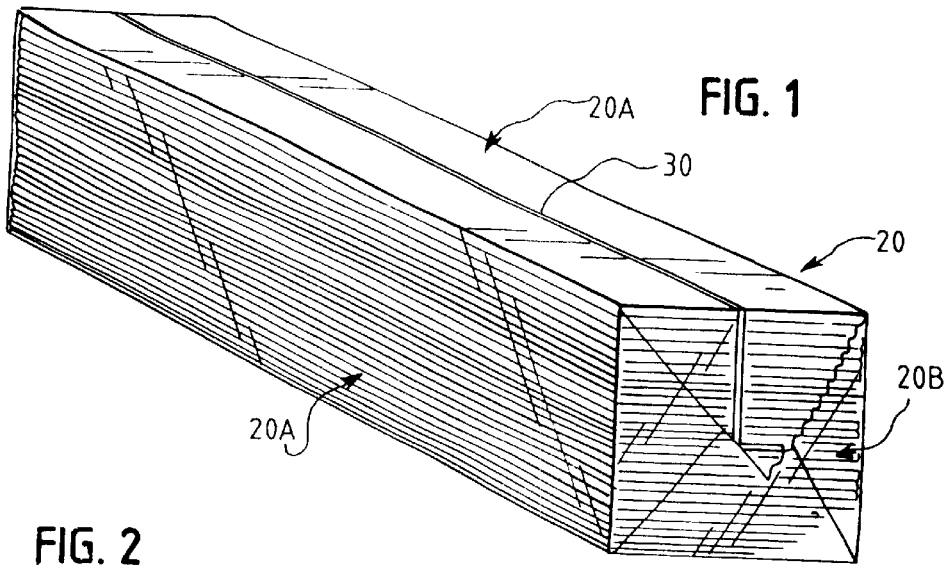
FIG. 1
FIG. 2
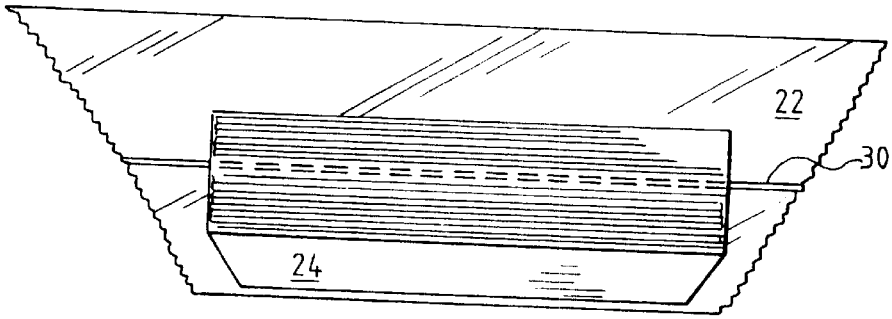
FIG. 3
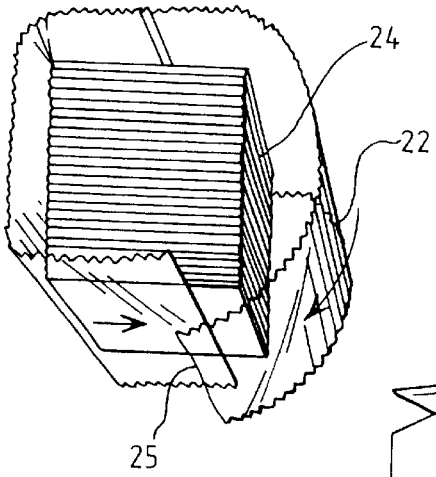
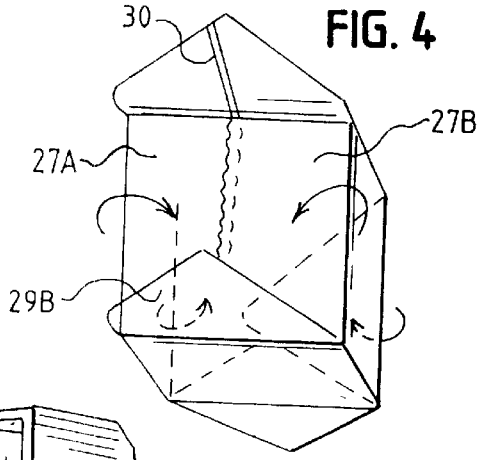
FIG. 4
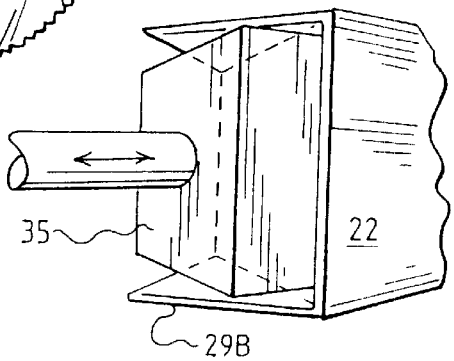
FIG. 5

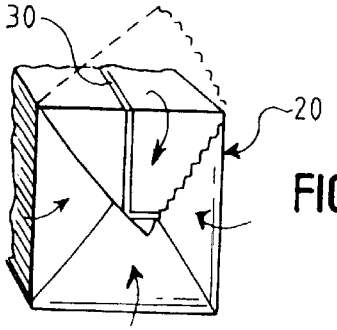
FIG. 6
FIG. 7
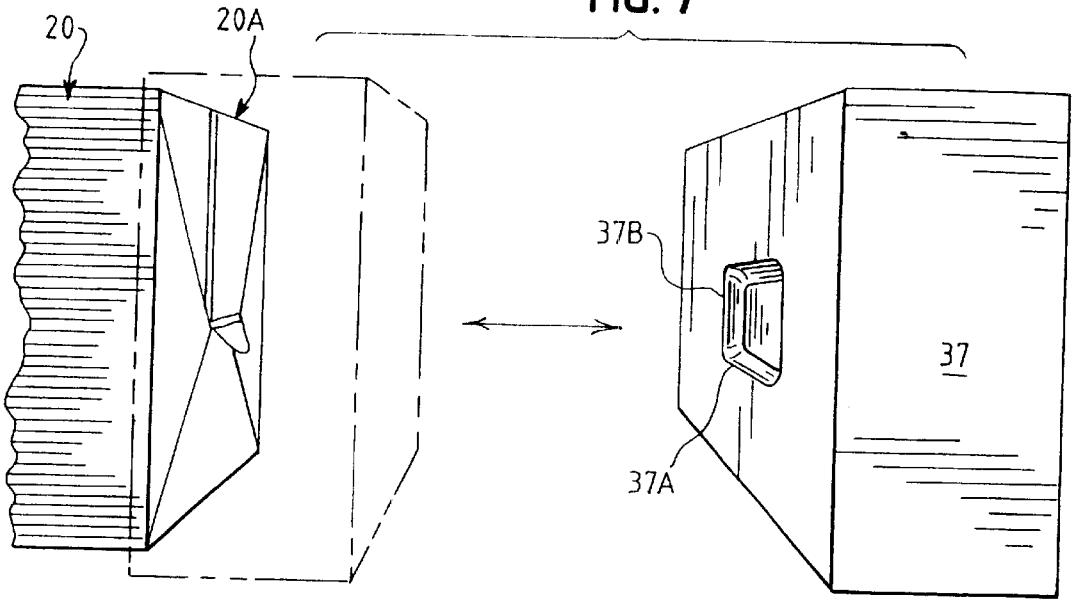
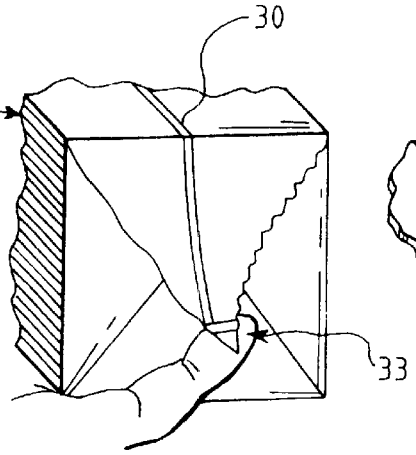
FIG. 8
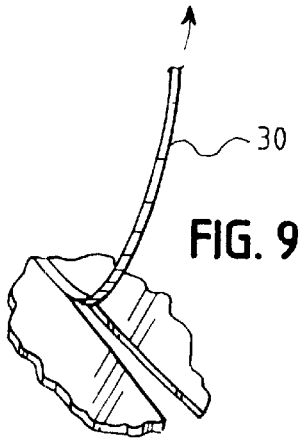
FIG. 9

FIG. 10
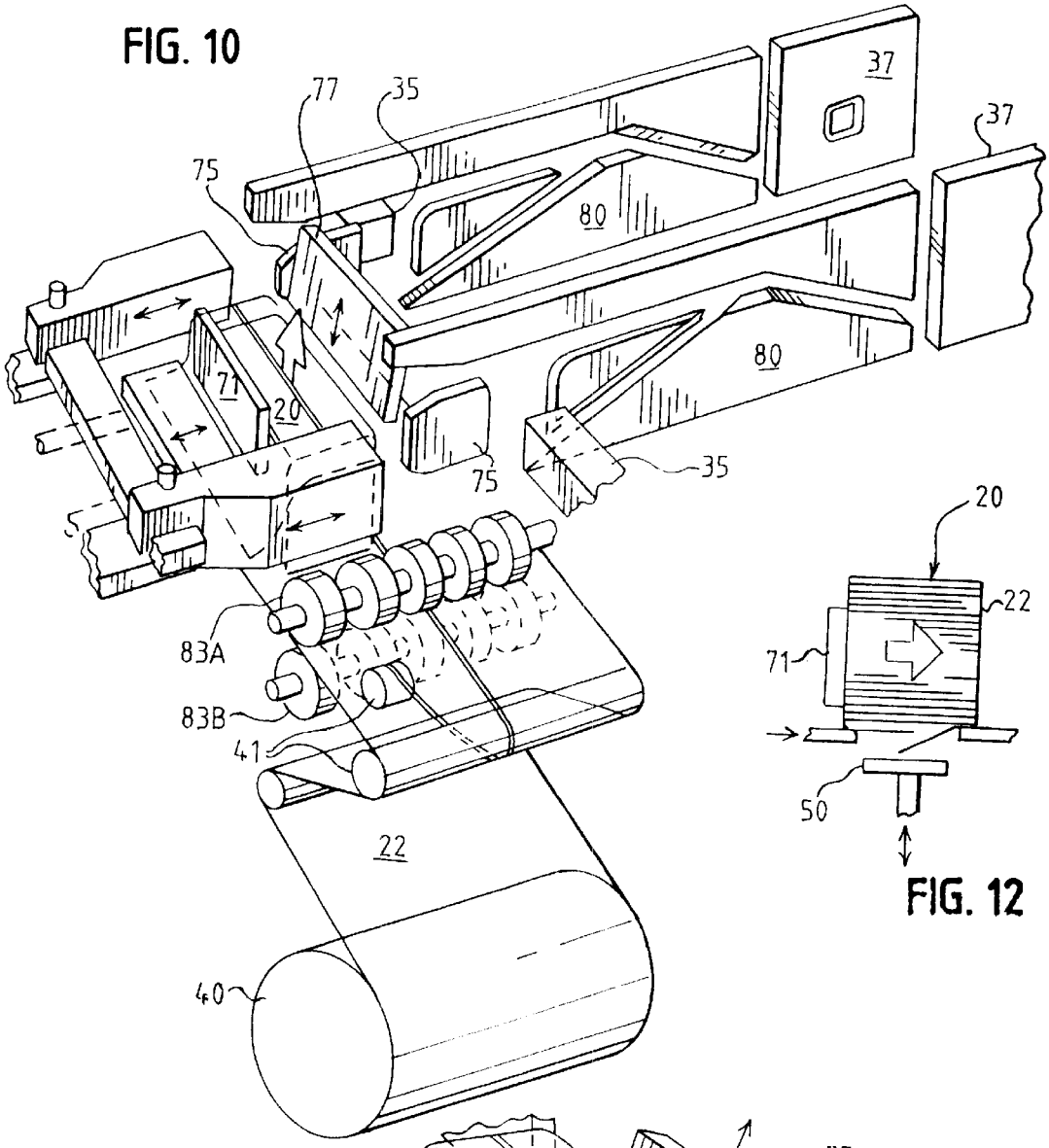
FIG. 12
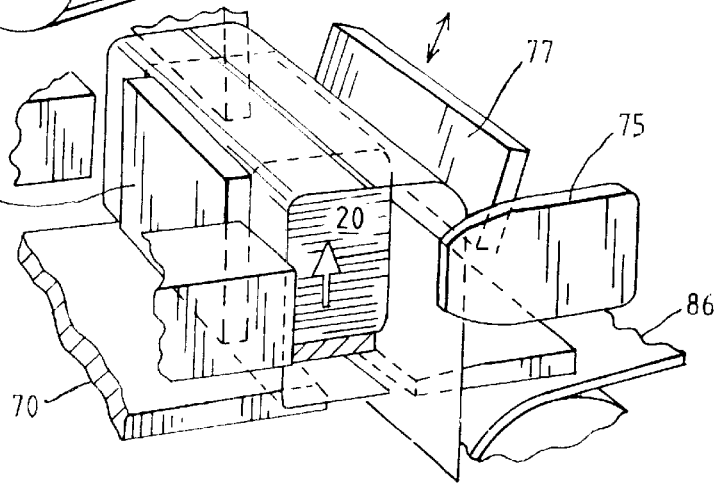
FIG. 11

FIG. 13
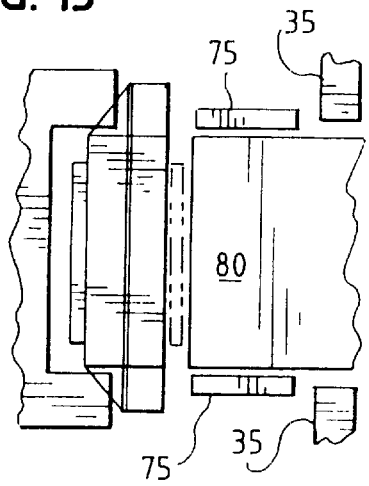
FIG. 14
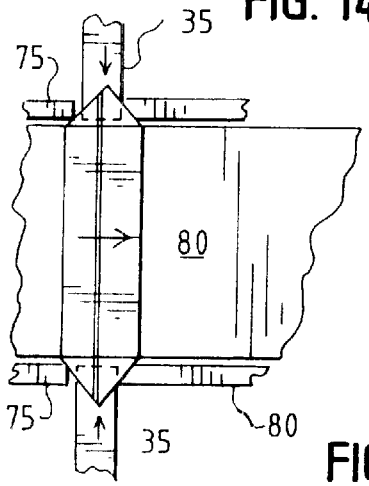
FIG. 16
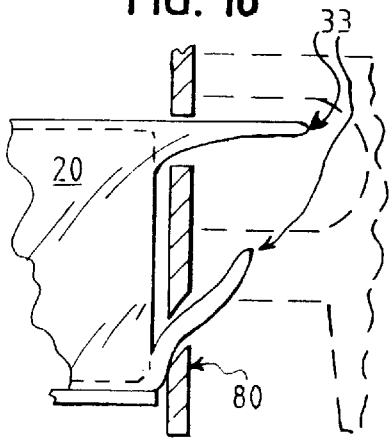
FIG. 15
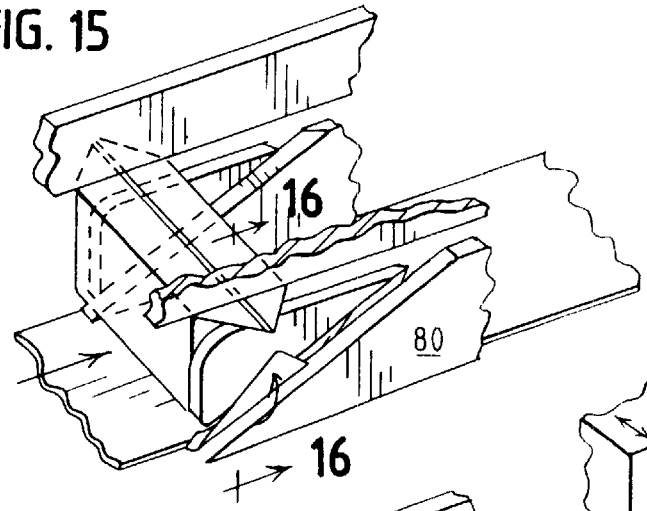
FIG. 17
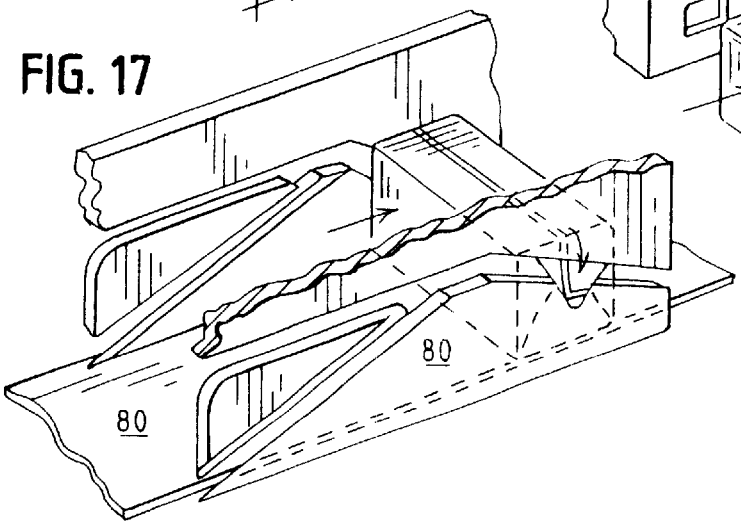
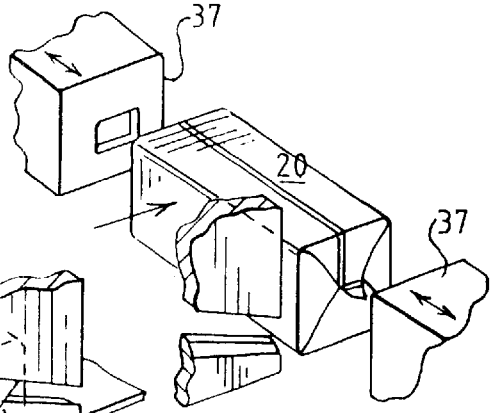
FIG. 18

EASY OPEN PACKAGE FOR FOOD ITEMS SUCH AS LOAVES OF PROCESSED CHEESE

This is a continuation of application Ser. No. 09/493,910 filed Jun. 28, 2000 now U.S. Pat. No. 6,339,912.

BACKGROUND OF THE INVENTION

The invention generally relates an easy open package for food items such as loaves of processed cheese. More specifically, the invention relates to a food package which employs a tear strip in combination with serrated film to provide a hermetically sealed, easy-open package.

It is desirable to hermetically seal food item packages such as loaves of processed cheese to preserve the food item. For this purpose film overwrap machines are available, such as the Hayssen 5000 Wrapper built by Hayssen, Inc., 225 Spartangreen, Duncan, S.C. (now owned by Paper Converting Machine Co., 2300 S. Ashland Ave., Green Bay, Wis.), and the Hart 3×12 Wrapper, built by Hart Design & Mfg., Inc., 1940 Radisson Street, Green Bay. Hermetically sealed packages may not be easily opened, however. Film packages employing heat or pressure sealable tear strips to facilitate the opening of sealed packages are known. See, e.g., U.S. Pat. Nos. 3,170,619; 3,566,752; 3,909,330; 3,933,568; 4,367,816; 4,498,274; 4,836,378; 4,848,649; 5,215,380; 5,704,481; and 5,899,333. Disadvantages remain with existing tear strip technology. Conventional overwrap machines known to use films with tear strips form packages with crimped extended ends, rather than flat ends, leaving air pockets at each end which promote contamination. Also, pulling on the tear strip may cause other portions of the film package to tear. Further, the tear strip may not be easily accessible, sometimes also resulting in the tearing of other portions of the film package during opening of the package, or the damage or contamination of the packaged item through puncture or other means. This may be undesirable in food packaging applications, or in applications where it is desired to re-pack portions of the unused food product. Finally, the film and/or tear strip may not permit easy and consistent opening of packages using a generally uniform force.

Accordingly, objects of the present invention include: the provision of a hermetically sealed food package, such as for loaves of processed cheese, that provides ready access to a tear strip; that permits easy package opening using a generally uniform force; and that limits or eliminates tearing of other portions of the film package, or contamination of the food item, during opening of the package.

Definition of Claim Terms

The following terms are used in the claims of the patent as filed and are intended to have their broadest meaning consistent with the requirements of law. Where alternative meanings are possible, the broadest meaning is intended. All words used in the claims are intended to be used in the normal, customary usage of grammar and the English language.

| | |
|---|---|
| tear resistance: | the resistance a packaging film has to tearing in any given direction |
| sealing force: | the force necessary to remove a tear strip, without tearing, from packaging film to which it has been applied by breaking the adhesive bond the tear strip has with the film |
| accessible end: | a tear strip end which can be relatively easily grabbed and pulled manually by a consumer |
| tear strip: | any strip of material affixed to a packaging film with a sealing force which is greater than the tear resistance of the film |
| hermetically sealed: | a plastic food package with seals that exclude air and are leakproof at normal temperatures and atmospheric pressure to the extent the packaging film permits |
| film tearing force: | the force necessary to tear the plastic film in any given direction |

SUMMARY OF THE INVENTION

The objects mentioned above, as well as other objects, are solved by the present invention, which overcomes disadvantages of prior art food packages such as for loaves of processed cheese, while providing new advantages not believed associated with such food packages.

In one preferred embodiment, a process is provided for forming an easily opened, hermetically sealed package of a food item. A plastic film with a certain tear resistance and serrated edges is used. The tear strip is affixed to the film so that the tear strip is sealed to the film by a sealing force that is greater than the tear resistance of the film. The tear strip runs with or is adjacent to at least one accessible, unsealed end of the film, which is adjacent one or more of the serrated edges of the film. The plastic film is formed about the food item and sealed, resulting in a hermetically sealed package entirely enclosing the food item. When thus enclosed, a pulling force exerted on the at least one accessible end results in concentration of a film tearing force beginning at one of the one or more serrated edges of the film adjacent the at least one accessible end, resulting in tearing of the film in a direction generally toward the tear strip following by tearing of the film in a direction parallel to the tear strip, thereby allowing easy opening of the package without damaging the food item.

The food item may be any of various foods, such as loaves of processed cheese or other items.

In a preferred process embodiment, the package has two opposing ends. At least one of the opposing ends includes two pairs of opposing flaps. One of the two pairs of flaps of an opposing end is at least partially sealed to each other; at this time, the sides may be sealed. In a subsequent step, the other of the two pairs of flaps of the opposing end is at least partially sealed to each other, to thereby form a package end which is hermetically sealed. Two different sealing bars may be used to accomplish this.

In one preferred embodiment, at least one of the package ends has an unsealed ear portion formed using a seal bar with an aperture, and the at least one accessible end of the tear strip lies adjacent the unsealed ear portion.

Preferably, the tear strip is continuously affixed to the film as the film is advanced and prior to formation of the hermetically sealed package. However, any expedient manner for affixing the tear strip may be used.

In another preferred embodiment, an easily opened, hermetically sealed package for completely enclosing a food item is provided. A plastic film having a tear resistance and serrated edges is formed about the food item and sealed. Prior to or during this process, a tear strip is affixed to the film by a sealing force that is greater than the tear resistance of the film. The tear strip is adjacent to or associated with at least one accessible, unsealed end of the film, which is adjacent one or more of the serrated edges of the film. A pulling force exerted on the at least one accessible end results in concentration of a film tearing force beginning at one of the one or more serrated edges of the film adjacent the at least one accessible end, resulting in tearing of the film in a direction generally toward the tear strip following by tearing of the film in a direction generally along the tear strip, thereby allowing easy opening of the package without damaging the food item.

The package may have opposing ends as recited, and formed as indicated, above. In one preferred package configuration, the package is generally rectangular with four sides and two opposing ends, and the tear strip runs in a lengthwise direction along one or more sides of the package. One of the sides may be hermetically sealed using a lap seal. Each end of the package is hermetically sealed and lays substantially flat against an adjacent edge of the food item.

The plastic film may be made of various suitable films used in the food packaging industry, such as polypropylene. Any suitable film thickness may be used, such as in a range of between about 100–180 gauge or, more preferably, about 120 gauge.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings, in which:

FIG. 1 is a perspective view of a loaf of processed cheese that has been hermetically sealed in a package, according to the present invention;

FIG. 2 is a bottom perspective view of the processed cheese loaf being met by the film from underneath;

FIGS. 3–7 are end partial perspective views showing consecutive packaging steps in the preferred embodiment of the process of the present invention which results in the hermetically sealed package shown in FIG. 1;

FIG. 8 is a partial perspective end view illustrating the accessible tear strip of the preferred embodiment;

FIG. 9 is an enlarged partial perspective view showing removal of the tear strip of the package embodiment shown in FIG. 8 without rupture of the packaging film;

FIG. 10 is a partial perspective view of a conventional overwrap (Hayssen) machine modified for use with the present invention;

FIG. 11 is an enlarged perspective view of the circled portion (labeled 11—11) of FIG. 10;

FIG. 12 is a side view showing the direction of the bottom seal bar relative to the loaf;

FIGS. 13 and 14 are top views illustrating the sequential movement of the side sealing bars;

FIGS. 15 and 17–18 are partial sequential perspective views showing the process steps of one preferred embodiment of the present invention in which folding and sealing of the top and bottom end flaps is accomplished;

FIG. 16 is a cross-sectional view taken along sections lines 16—16 of FIG. 15.

DETAILED DESCRIPTION OF THE PREFERRED EMBODIMENTS

Figure 19:
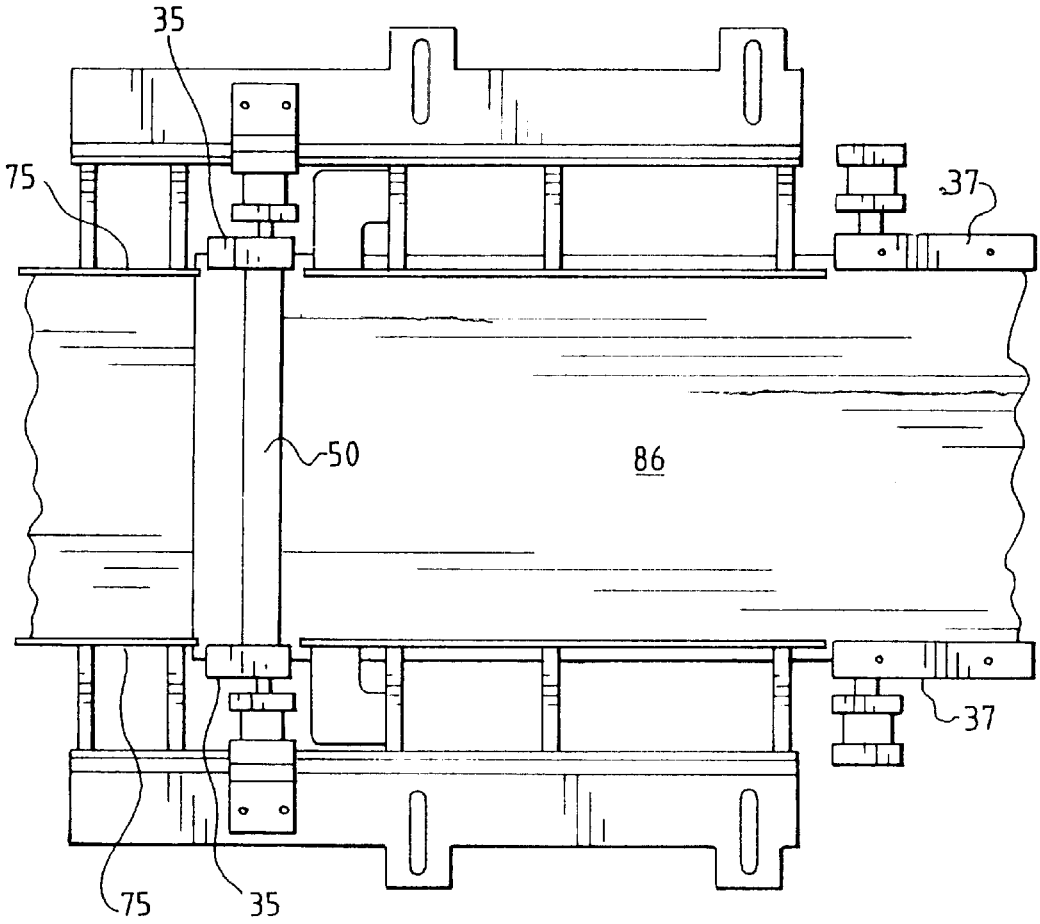
FIGS. 19 and 20 are top and side views, respectively, of a portion of the overwrap machine which forms the preferred embodiment of the present invention.

Set forth below is a description of what are currently believed to be the preferred embodiments and/or best examples of the invention claimed. Future and present alternatives and modifications to these preferred embodiments are contemplated. Any alternatives or modifications which make insubstantial changes in function, in purpose, in structure or in result are intended to be covered by the claims of this patent.

FIG. 1 illustrates a hermetically sealed package, generally designated with reference numeral 20, of an (e.g.) 3- or 5-pound loaf of processed cheese made according to the present invention. Of course, it will be understood that the present invention may be adapted for use in packaging items other than loaves of processed cheese, such as cheese singles, as well as chocolate, lasagna, biscuits,etc.

The exemplary process for forming the hermetically sealed package of the present invention is now described with regard to drawings generally showing a conventional overwrap machine available from Hayssen (now Paper Converting) which has been modified in the manner discussed below. The film typically used for packaging loaves has also been modified to include serrated edges and a tear strip, as further discussed below.

In overview, and referring first to FIGS. 1–9, the exemplary process of the present invention provides a hermetically sealed rectangular package 20 with four long sides 20A and two ends 20B, as follows. Referring to FIGS. 2–3, a suitable packaging film 22 is arranged adjacent the item to be packaged and folded longitudinally about the loaf as shown. Film 22 has serrated ends 22A which facilitate tearing of the film, as further explained below. The film is then sealed along its longitudinal edge 25 (parallel to the length of cheese loaf 24) using either a lap or fin seal, although a lap seal is typical. At this same time, side flaps 27A, 27B of each end portion are folded over and sealed (FIGS. 4–5). Then, top and bottom flaps 29A, 29B of each end portion are folded over and sealed (FIGS. 6–7), leaving an unsealed ear portion 33 (FIG. 8) which is easily accessible. A tear strip 30 is adhesively attached to the film before the folding step and as the film is unrolled, and extends through the unsealed ear portion 33.

Figure 20:
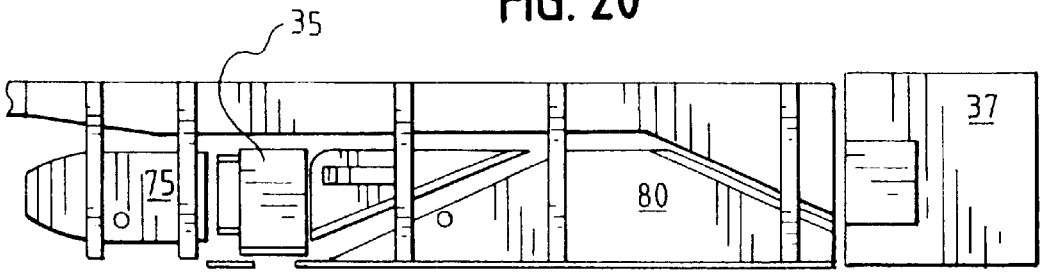

The overwrap machine used in the preferred process of the present invention is modified in certain important respects from conventional overwrap machines used for the packaging of loaves of processed cheese, as now described. Conventional overwrap machines used for sealing the ends 20A of packaged loaves of processed cheese employ a single pair of flat heated sealer bars, roughly equivalent in size to the height and width dimensions of the package ends. This single pair of sealer bars is used, at a single time, to hermetically seal each end flap of the package after the side flaps and the top and bottom flaps have been folded over. With the present invention, as shown best in FIGS. 5, 7, 13–14 and 19–20, two pairs of heated sealer bars (together with a modified non-continuous cover plate, as shown) are used. The first pair of heated sealer bars 35, preferably dimensioned roughly as shown in FIG. 5 (i.e., having a width generally coextensive with or greater than the package end width, and a height slightly less, on each top and bottom edge, than the length of the package end, such as ¼-inch less), seals the side flaps together. The second pair of heated sealer bars 37, again dimensioned roughly as shown (i.e., with dimensions coextensive or greater than the dimensions of the package end), seal top and bottom flaps 29A, 29B to each other and to side flaps 27A, 27B such that hermetic seals form wherever the plastic film overlaps in this region. Due to the relief or cut-out section 37A of bar 37, with radiused edges 37B, which results in unsealed ear portion 33, the side flaps 27A, 27B must first be sealed in the area of this relief section 37A; otherwise, a hermetic seal cannot be formed at the ends of the package. In other words, unlike conventional overwrap machines, the modified overwrap machine used in the preferred process of the present invention provides a hermetically sealed package end with an accessible, unsealed ear portion 33, as shown in FIG. 8.

Film 22 is also modified in an important manner from the typical film used in conventional overwrap machines for packaging loaves of processed cheese. Thus, referring to FIGS. 2–3, film 22 includes serrated ends 22A. Serrated ends 22A provide points of focus to facilitate tearing of the film. Referring to FIG. 8, the film with serrated edges 22A is easily torn in a direction generally toward tear strip 30, at which point uniform tearing generally along tear strip 30 commences, as shown in FIG. 9. (The tear may be wider, in some cases, than shown, but will be generally parallel and adjacent the tear strip.) Accordingly, the package 20 may be easily opened without damaging or unduly contaminating the food item simply by manually pulling on accessible end 33.

Tear strip 30 is preferably a pressure sensitive tape which adheres to film 22 using an adhesive. Tear strip 30 has a sealing force which is greater than the tear resistance of the film. A suitable tear strip, known as Supastrip® XL Teartape, is available from P. P. Payne, Inc. of Ashland, Va. (mail@pppayne.com); suitable dispensing apparatus is also available form P. P. Payne and/or Supastrip International.

Referring now to FIG. 10, a roll 38 of tear strip 30 may be unwound and tear strip 30 applied to film 22 as the film is unwound from film roller 40. As shown, the tension of the film as it moves over rollers 41, for example, applies sufficient pressure to cause tear strip 30 to adhere to the underside of film 22. Opposing film feed rolls 83A and 83B rotate, pinch the film and help keep the film moving in a continuous forward direction. Referring to FIGS. 10 and 11, loaf 20 is moved vertically upward to meet the film, and is thus wrapped about the length of the cheese loaf. Shoe 70 moves horizontally on dead plate 86 and cooperates with tucker plates 71 and 77 to tuck the sides of the film about the underside of the loaf in an overlapping fashion. Heated sealer bar 50 (see FIGS. 12 and 19) then moves vertically upward to form into a hermetical lap seal the film overlap region thus formed on the underside of the loaf. At the same time, vertical end flaps 27A and 27B are being folded by folding shoe 75 (see FIG. 11) and sealed by the first set of seal bars 35.

Next, the semi-packaged loaf, with open end flaps, is moved horizontally through a folding apparatus, such as shown in FIGS. 15–17 and 20. The upwardly sloping taper of plate 80 acts to fold the bottom end flap upwardly, as shown in FIGS. 15 AND 16. The downwardly sloping taper of plate 80 then acts to fold the upper end flap downwardly, as shown in FIG. 17. Immediately after exiting plate 80, heated sealing bars are used to hermetically seal the end seals, as shown in FIGS. 7 and 18, to form the completed, hermetically sealed package 20, with accessible tear strip 30 and substantially flat end portions 20B that leave little room for unwanted air pockets.

It will be understood that the sealer bars mentioned here should be heated to temperatures sufficient to activate the adhesive within the packaging film, and to form a suitable hermetic seal. Any suitable packaging film known may be used, such as polypropylene. Film thicknesses may vary, but are preferably about 100–180 gauge and, more preferably, about 120 gauge such as for the processed cheese loaf application.

The above description is not intended to limit the meaning of the words used in the following claims that define the invention. For example, it will be understood that other wrapping machines not specifically mentioned here that accomplish the same general folding and packaging operations may do so in substantially different ways, while still providing a hermetically sealed package within the principles of the present invention. Rather, it is contemplated that future modifications in structure, function or result will exist that are not substantial changes and that all such insubstantial changes in what is claimed are intended to be covered by the claims.

We claim:

1. A process for forming an easily opened, sealed food package having two opposing ends with at least one of the opposing ends of the package including at least one pair of opposing flaps, comprising the steps of:

providing a plastic film having a tear resistance;

wrapping the plastic film about a food item and using the plastic film to form the at least one pair of opposing flaps;

the plastic film having associated with it a tear strip that adheres to the film with a tear force that is greater than the tear resistance of the film, the tear strip having at least one accessible end associated with at least one accessible, unsealed end of the film;

at least partially sealing the at least one pair of opposing flaps to each other, to thereby form a package end which is sealed, the sealing step being performed such that at least one opposing end of the package has an unsealed ear portion formed by using a seal bar with an aperture, and the at least one accessible end of the tear strip lies adjacent the unsealed ear portion;

wherein a pulling force exerted on the at least one accessible end results in concentration of a film tearing force adjacent the at least one accessible end, resulting in tearing of the film in a direction generally parallel to the tear strip, thereby allowing easy opening of the package without damaging the food item.

2. The process of claim 1 for forming a package, wherein the food item is a loaf of processed cheese.

3. The process of claim 1 for forming a package, wherein the tear strip is continuously affixed to the film as the film is advanced and prior to formation of the hermetically sealed package.

4. The process of claim 1 for forming a package, wherein first and second pairs of end flaps are formed in the wrapping step, and further comprising the step of least partially sealing the first and second pairs of end flaps in the manner described in claim 1 using first and second pairs of sealing bars.

5. The process of claim 1, wherein the film has a thickness of between about 100–180 gauge.

6. The process of claim 1, wherein each of the seals are hermetic such that a a hermetically sealed package entirely enclosing the food item within the plastic film package is provided.

* * * * *